US010993504B1

(12) United States Patent
Li

(10) Patent No.: US 10,993,504 B1
(45) Date of Patent: May 4, 2021

(54) APPARATUS FOR FASTENING SHOELACES

(71) Applicant: Fude Li, Nanchang (CN)

(72) Inventor: Fude Li, Nanchang (CN)

( * ) Notice: Subject to any disclaimer, the term of this patent is extended or adjusted under 35 U.S.C. 154(b) by 0 days.

(21) Appl. No.: 17/078,815

(22) Filed: Oct. 23, 2020

(30) Foreign Application Priority Data

Sep. 28, 2020 (CN) ..... 202011037577.1

(51) Int. Cl.
*A43C 11/16* (2006.01)
*A43C 11/20* (2006.01)

(52) U.S. Cl.
CPC ..... *A43C 11/165* (2013.01); *A43C 11/20* (2013.01)

(58) Field of Classification Search
CPC ..... A43C 11/165; A43C 11/20; A43C 7/00; B65H 75/4431; Y10T 24/2183; Y10T 24/3724
See application file for complete search history.

(56) References Cited

U.S. PATENT DOCUMENTS 10,039,345 B2 * 8/2018 Ha ..... A43C 11/16
10,368,613 B2 * 8/2019 Ha ..... A43C 11/165
10,660,404 B2 * 5/2020 Chen ..... A43C 7/00
10,772,385 B2 * 9/2020 Jiang ..... B65H 75/4431
2013/0025100 A1 * 1/2013 Ha ..... A43C 11/165 24/712.9
2015/0191326 A1 * 7/2015 Hall ..... A42B 3/08 242/396.4
2018/0160775 A1 * 6/2018 Pollack ..... A43C 7/00

* cited by examiner

*Primary Examiner* — Robert Sandy
*Assistant Examiner* — Rowland Do
(74) *Attorney, Agent, or Firm* — Mark Terry

(57) ABSTRACT

An apparatus for fastening a shoelace threaded in a shoe includes a wheel bin having a receptacle on its top surface, a toothed ring inside the receptacle, and protrusions configured for coupling with mating orifices, a winding wheel having a central cylinder with protruding load ribs, a channel for storing shoelace and orifices through which the shoelace is threaded, a pawl ring with ratcheted ends that engage the toothed ring, a base including a curved surface and a receptacle having mating orifices for coupling with the protrusions of the wheel bin, a screw cap configured for placement on top of the wheel bin, the screw cap having a ring structure configured for coupling with the protruding load ribs of the winding wheel, wherein when the screw cap is rotated, the winding wheel tightens the shoelace and stores excess length of shoelace in the channel.

16 Claims, 13 Drawing Sheets

APPARATUS FOR FASTENING SHOELACES

CROSS-REFERENCE TO RELATED APPLICATIONS

This patent application claims priority to Chinese patent application number 202011037577.1 filed on Sep. 28, 2020. The subject matter of Chinese patent application number 202011037577.1 is hereby incorporated by reference in its entirety.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

TECHNICAL FIELD

The claimed subject matter relates generally to clothing and footwear and, more specifically, the claimed subject matter relates to devices for securing, tightening, and loosening the shoelaces of a shoe.

BACKGROUND

With a history dating back over 5,500 years, the evolution of shoes, and consequentially shoelaces, is made up of a robust portfolio of ideas and concepts thought to improve the shoe tying and wearing experience for people of all kind. Today, the most commonly used shoes by far and large include shoelaces typically made of nylon or some other synthetic material, made for tying by hand in a variety of ways. The most common method of tying shoes is often referred to as the "bunny ears" method, and comprises holding a portion of the string in each hand, crossing the hands to create an "X" with the laces, tucking the top string underneath the bottom and pulling it through, creating bunny ears and creating a second "X" with them, and finally taking the bottom bunny ear and looping over and then under the top to finish the knot. Unfortunately, this process can be inconvenient, complicated for some, such as children typically under age 6, and onerous for others, such as those dealing with physical limitations like arthritis, and other ailments of varying severity that impact dexterity, mobility, and flexibility.

Additionally, for those who are able tie their shoes without issues arising relating to comprehension or physical ability, other problems remain. For many, during use, the impact with ground loosens the knot, thereby allowing the flailing of the string ends to lead to further loosening of the string until eventually the tied knot comes entirely undone. This creates the risk of injury to not only the wearer but often times others in the vicinity. Some users report feeling foot pain associated with tightness of their strings when trying to avoid the dangerous loosening of laces discussed above, specifying pain in the arch of their foot, heel, and toes.

Many shoe styles and products with lace alternatives have been released in response to the issues recognized above, but in most cases these alternatives likewise fall short in providing the solution needed. For example, self-tying shoes, one of the more recent developments in the space, require a battery to be recharged using a peripheral device as well as a smart phone for control and analytic reporting. These shoes have also been reported as having numerous bugs associated with software updates and impacting convenient and proper use. Lace-less (or slip-on) shoes often fit poorly, presenting a risk of injury similar to that of untied or ill-fit shoes, and causing discomfort or pain as a result of the inability to customize the fit in anyway. Cord locks, or lace locks, come in many forms however their configuration, using a spring and requiring that laces be passed through manually, as well as size leaves those with physically limiting situations like arthritis similarly unable to operate the product.

In light of at least the above-mentioned examples, it is clear that numerous shortfalls still exist in the present state of the shoe and shoelace markets, leaving many consumers searching for alternatives to fit their needs. Specifically, consumers have a need for a safe, reliable, and adjustable apparatus for securing shoes while reducing the physical and cognitive burden of doing the same, and ensuring that the laces will not loosen, thereby reducing the risk of injury.

SUMMARY

An apparatus for fastening a shoelace threaded in a shoe is disclosed. The apparatus comprises: (a) a wheel bin having a receptacle on its top surface, a toothed ring inside the receptacle, at least two orifices through which the shoelace is threaded, and at least two protrusions configured for coupling with mating orifices; (b) a winding wheel that fits within the receptacle in the wheel bin, the winding wheel having a central cylinder with protruding load ribs, a channel for storing excess length of shoelace and at least two orifices through which the shoelace is threaded; (c) a pawl ring that fits within the receptacle in the wheel bin, such that the central cylinder extends through a center of the pawl ring, the pawl ring having a plurality of ratcheted ends that engage the toothed ring; (d) a base comprising a curved surface and a receptacle on the top side of the surface, the receptacle including mating orifices configured for coupling with the at least two protrusions of the wheel bin; and (e) a screw cap configured for placement on top of the wheel bin, the screw cap having a ring structure configured for coupling with the protruding load ribs of the winding wheel, (f) wherein when the screw cap is rotated, the winding wheel tightens the shoelace and stores excess length of shoelace in the channel.

BRIEF DESCRIPTION OF THE FIGURES

The claimed subject matter is particularly pointed out and distinctly claimed in the claims at the conclusion of the specification. The foregoing and other features and also the advantages of the disclosed embodiments will be apparent from the following detailed description taken in conjunction with the accompanying drawings.

DETAILED DESCRIPTION

Figure 1:
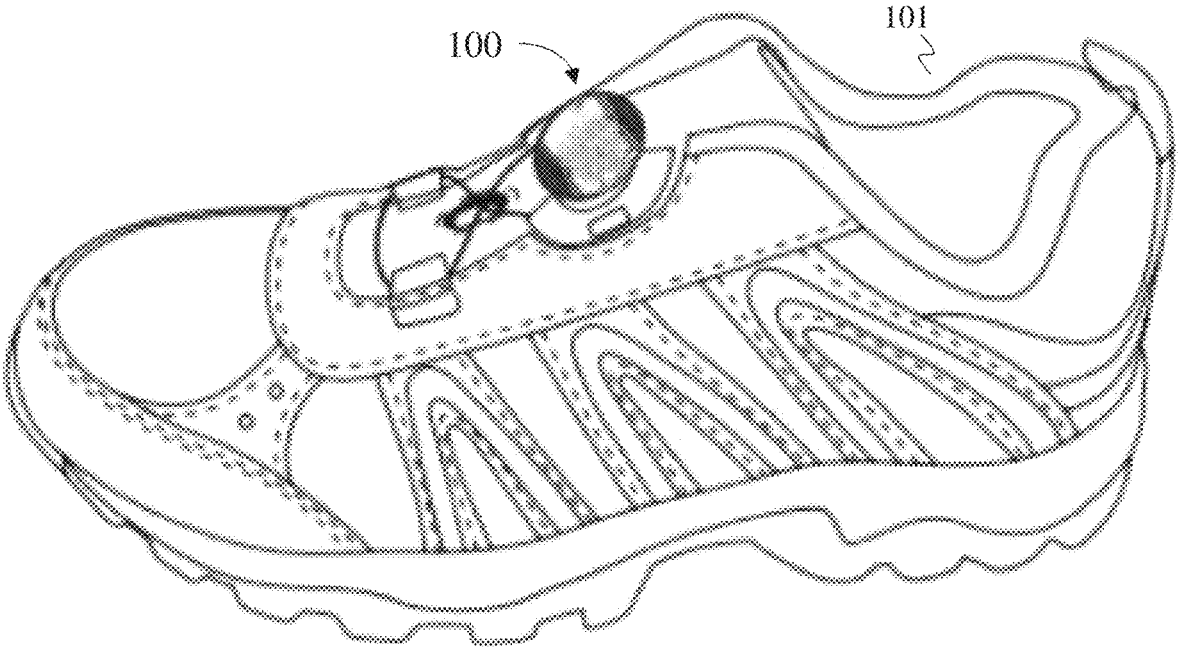
FIG. 1 is a drawing showing a perspective view of an apparatus for fastening shoelaces, as located on a shoe, according to one embodiment.

The following detailed description refers to the accompanying drawings. Wherever possible, the same reference numbers are used in the drawings and the following description to refer to the same or similar elements. While embodiments may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the claimed subject matter. Instead, the proper scope of the claimed subject matter is defined by the appended claims.

The claimed subject matter improves over the prior art by providing an apparatus for fastening shoelaces that reduces or eliminates the burdens associated with the use of traditional shoelaces and the methods typically used to secure them. Specifically, the claimed subject matter improves over the prior art by providing an apparatus that allows the user to properly fasten their shoelaces simply and quickly by twisting the apparatus, thereby eliminating the physical burdens associated with pro-longed and regular bending, grasping for laces, or kneeling. This also reduces the cognitive burden associated with tying shoelaces, allowing children and others unable to tie their own shoes the opportunity to do so with ease.

The claimed subject matter further improves over the prior art by reducing, or eliminating, the risk associated with the loosening of shoestrings and the burden of having to re-tie shoelaces during use by providing an apparatus with components that prevents everyday actions like walking or running from loosening the shoelaces. Additionally, the claimed invention improves over the prior art by providing a convenient way to introduce the above discussed shoelace tying alternative in shoes that consumers already enjoy, thereby avoiding the need to travel to a store or order online to try various uncomfortable alternatives before finding one that meets the user's needs. The claimed subject matter also improves over the prior art by providing a shoelace fastening apparatus that is simply designed with fewer components and fewer moving parts, resulting in a device that is lighter in weight, quick and inexpensive to manufacture, and has a longer mean time to failure.

Referring now to the figures, FIG. 1 is a drawing depicting a perspective view of an apparatus for fastening shoelaces 100, according to an example embodiment. The apparatus 100 has a curved base 190 (see FIG. 12) configured to facilitate placement of the apparatus on the tongue of a shoe 101 near the collar or topline of the shoe. This placement allows the apparatus to function in a similar manner and location as the knot of tied shoelaces would in other situations, reducing the need for users to learn a new system or acclimate to fastening shoes in a substantially different manner. While the apparatus shown in FIG. 1 is being used with an athletic style of shoe 101, this drawing is merely a depiction of an example embodiment, and the claimed embodiments may be used in a wide variety of alternate shoe styles.

Figure 2:
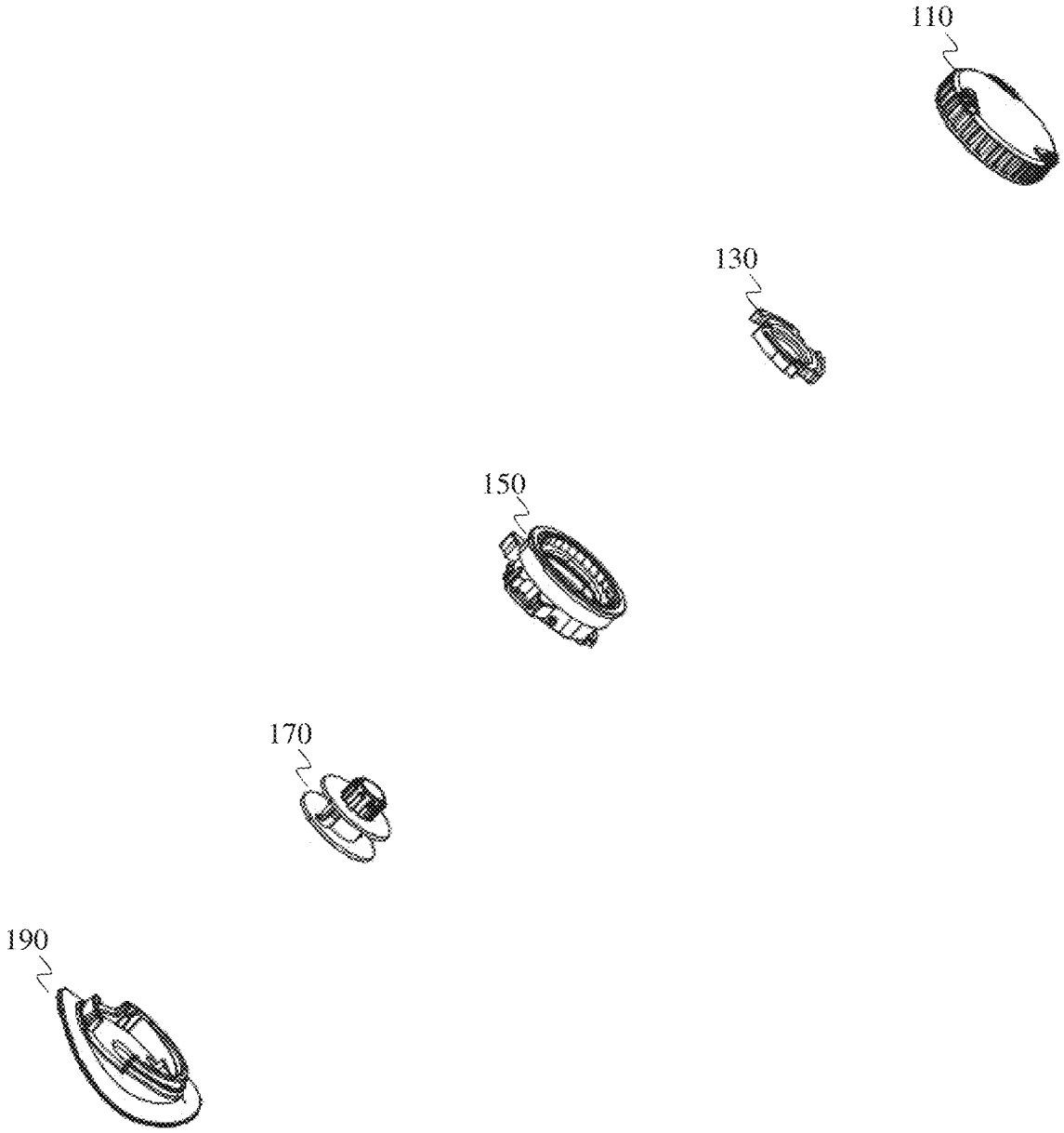
FIG. 2 is a drawing showing an exploded top perspective view of an apparatus for fastening shoelaces, according to one embodiment.
Figure 3:
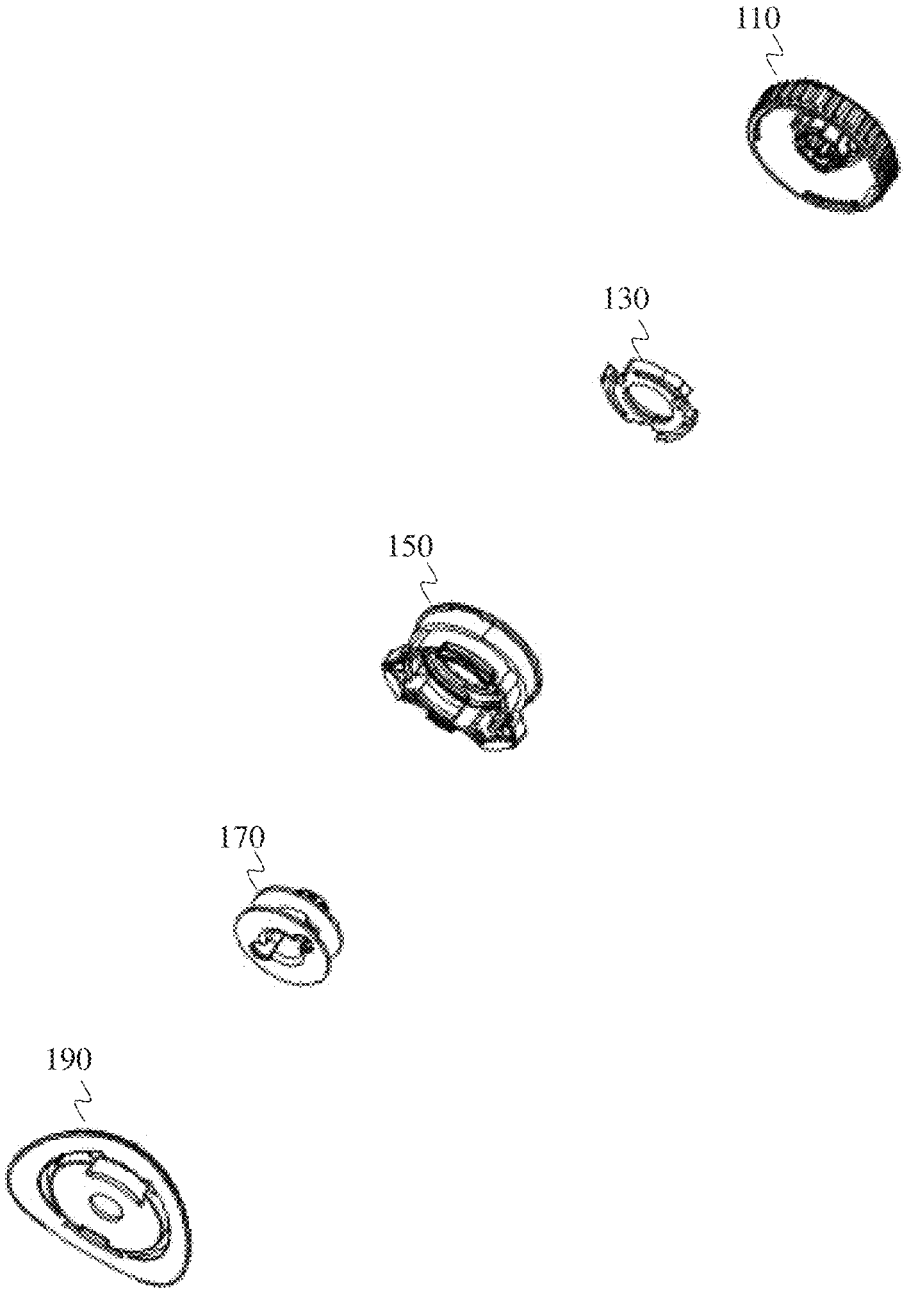
FIG. 3 is a drawing showing an exploded bottom perspective view of an apparatus for fastening shoelaces, according to one embodiment.

FIG. 2 and FIG. 3 are exploded views of an apparatus for fastening shoelaces, according to one embodiment. Specifically, FIG. 2 is a drawing showing both top and side views of each component of the apparatus for fastening shoelaces. FIG. 3 alternatively shoes bottom and side views thereof, further exposing the inner workings of the apparatus, which are discussed below. The figures reveal each component as they relate to one another and illustrate the nature of assembly, showing that during assembly each component may either be placed inside of another component and coupled by a snap-fit or, as the case is with screw cap 110, encapsulate one another. Specifically, FIG. 2 and FIG. 3 show screw cap 110, pawl ring 130, wheel bin 150, winding wheel 170, and base 190. Each component of the apparatus 100 for fastening shoelaces will be discussed in further detail below.

Figure 4:
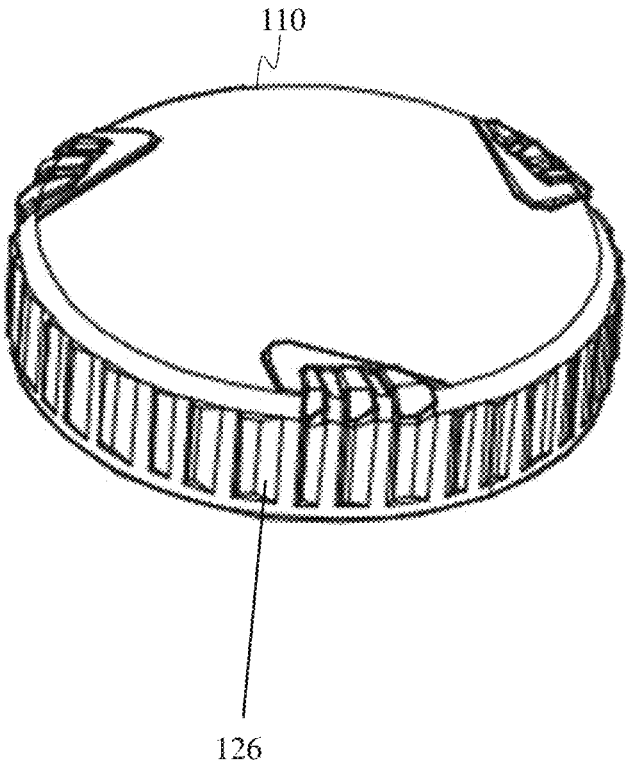
FIG. 4 is a drawing showing a top perspective view of the screw cap of an apparatus for fastening shoelaces, according to one embodiment.

FIG. 4 is a perspective view drawing depicting the top side of the screw cap 110 of the apparatus for fastening shoelaces 100. The screw cap plays an important role in the function of the apparatus, acting as the tool by which the inner components are activated and triggered to carry out their respective functions. This process is initiated through interaction with the screw cap on the part of a user, wherein the user engages the screw cap by twisting the screw cap clockwise until a "click" noise is heard and the shoe has been fastened tightly enough for the user's comfort. The screw cap 110 is cylindrical and contains a plurality of grooves 126 lining the cylindrical side wall of the screw cap. These grooves facilitate gripping the screw cap while using the apparatus and thereby reduce the amount of force that must be exerted in order to operate the apparatus for fastening shoelaces.

Figure 5:
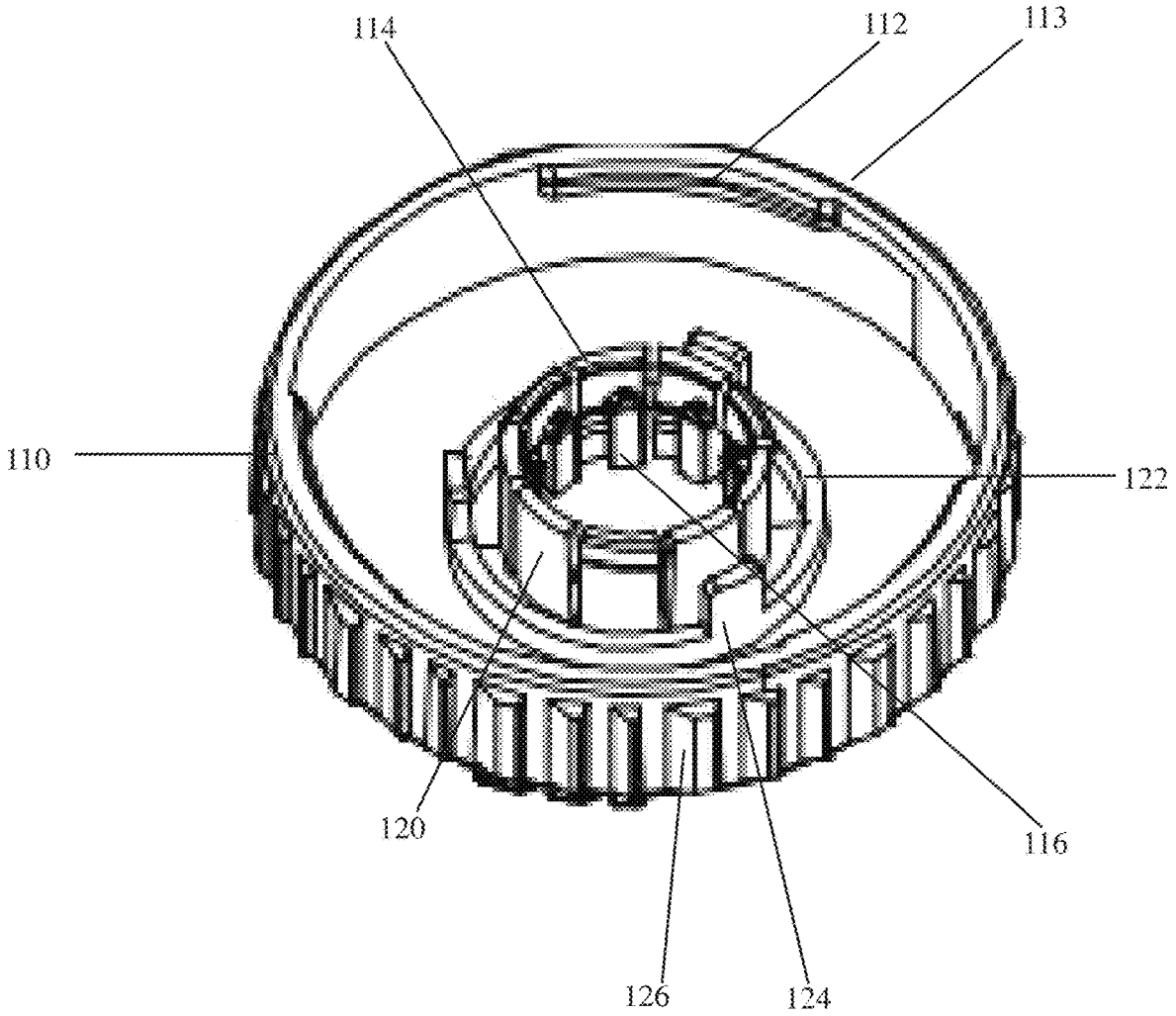
FIG. 5 is a drawing showing a bottom perspective view of the screw cap of an apparatus for fastening shoelaces, according to one embodiment.

FIG. 5 is a bottom perspective of the same screw cap 110 as shown in FIG. 4. FIG. 5 shows that screw cap 110 comprises an outer wall 113 and locking protrusions 112 located near the top of the inner surface of the outer wall, or cylindrical side wall, and extending inwards towards a center point of the screw cap. The locking protrusions are sized and shaped (i.e., configured) for fitting over and around protrusions 160 of wheel bin 150 (see FIG. 8) such that the protrusions 160 of wheel bin 150 prevent the screw cap 110 from being removed from the wheel bin, since the locking protrusions 112 conflict with the protrusions 160 of wheel bin 150.

At the center of the screw cap 110 there is a ring structure 114 comprised of various functional features. The ring structure 114 includes a plurality of buckle structures 120 that each comprise a singular element extending upwards from the screw cap. Load ribs 116 are protrusions on the inner portion of the ring structure 114. Said load ribs 116 are sized and shaped (i.e., configured) for coupling with load ribs 174 of the winding wheel 170 (see FIG. 9), such that the load ribs 116 fit securely around, and mate with, the load ribs 174 of the winding wheel 170. Surrounding the ring structure 114 is a peripheral ring structure 122 comprised of various functional features. The peripheral ring structure 122 comprises a plurality of buckle structures 124 that each comprise a singular element extending upwards from the screw cap. Each of the buckle structures 124 of peripheral ring structure 122 are shaped and sized (i.e., configured) for secure inserting into a corresponding one of the grooves 136 of pawl ring 130 (see FIG. 6). Further, the buckle structures 120 of ring structure 114 are shaped and sized (i.e., configured) for secure inserting into the central orifice 139 of pawl ring 130 (see FIG. 6). Therefore, when device 100 is assembled, the pawl ring is held between the buckle structures 120 of ring structure 114 and the buckle structures 124 of peripheral ring structure 122.

Figure 6:
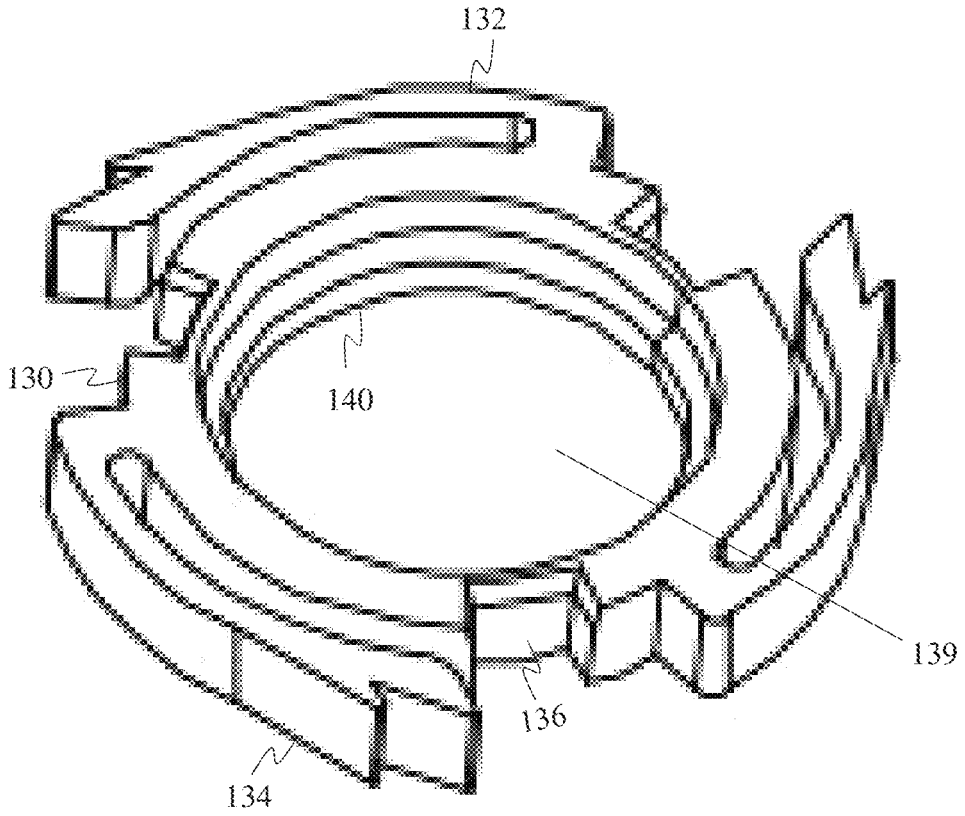
FIG. 6 is a drawing showing a perspective view of the pawl ring of an apparatus for fastening shoelaces, according to one embodiment.

FIG. 6 is a drawing depicting a pawl ring 130 consisting of three (3) pawl arms 132 surrounding a central orifice or opening 139. Each pawl arm 132 of pawl ring 130 contains a ratcheted end 134 protruding from the pawl arm near its terminal or distal end. The ratcheted ends are configured to interact with the toothed ring 152 of wheel bin 150, allowing the rotating components of the apparatus to rotate smoothly in one direction while preventing rotation in the opposing direction. This rotation likewise is in sync with the above discussed clockwise rotation of the screw cap. As the pawl ring rotates inside of the toothed ring 152 of wheel bin 150 in the direction allowed by the pawl ring, an audible clicking sound is heard by the user. The pawl ring cannot be rotated (or is prevented from rotating) inside the toothed ring 152 of wheel bin 150 in the direction not allowed by the pawl ring. Therefore, the pawl ring functions as a pawl within the toothed ring 152 of wheel bin 150.

Pawl ring 130 further comprises three (3) grooves 136 spaced evenly between the pawl arms. As mentioned above, the grooves 136 are configured to allow alignment, and ultimately coupling, with protruding buckle structures 124 of the peripheral ring structure 122 found on screw cap 110 (see FIG. 5). Pawl ring 130 additionally contains a central orifice or opening 139 lined by a slightly protruding peripheral edge 140. The peripheral edge 140, found on the bottom side of opening 139, is configured for alignment and subsequent coupling with buckle structures 120 of ring structure 114. Specifically, buckle structures 120 are configured for creating a snap-fit lock with peripheral edge 140 of opening 139. Additionally, protruding buckle structures 124 are configured to fit into grooves 136 when buckle structures 120 are snapped into place. Therefore, the pawl ring is held between the buckle structures 120 of ring structure 114 and the buckle structures 124 of peripheral ring structure 122.

Figure 7:
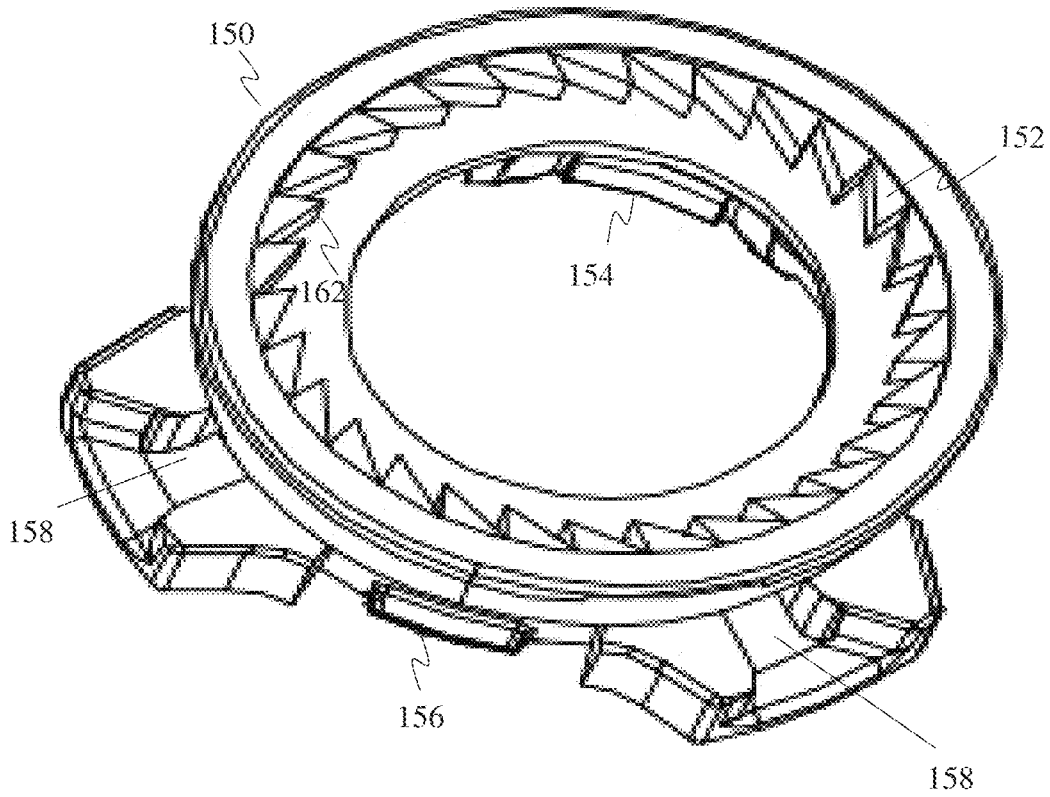
FIG. 7 is a drawing showing a top perspective view of the wheel bin of an apparatus for fastening shoelaces, according to one embodiment.
Figure 8:
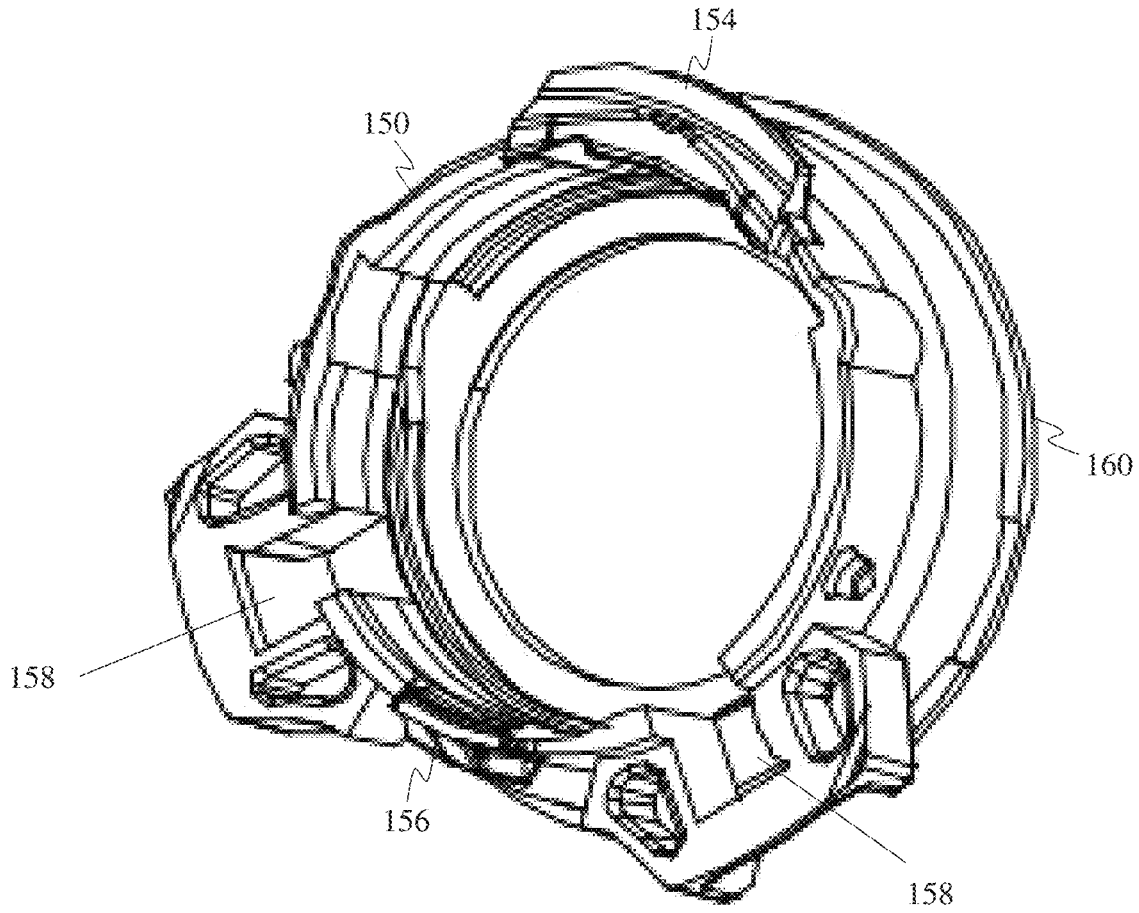
FIG. 8 is a drawing showing a bottom perspective view of the wheel bin of an apparatus for fastening shoelaces, according to one embodiment.

FIG. 7 and FIG. 8 are drawings showing the wheel bin 150 of an apparatus for fastening shoelaces from top and bottom views, respectively. In FIG. 7, the toothed ring 152, discussed above, is shown. The teeth 162 of the toothed ring are responsible for "catching" or locking a rotating device in a specific position using a tool such as a pawl arm and preventing the device from rotating in the opposite direction (see pawl arm 132 in FIG. 6). Both a large cantilever protrusion 154 and a small cantilever protrusion 156 are also shown in FIG. 7 and appear more visibly in FIG. 8. Cantilever protrusions 154 and 156 are configured for snap-fit coupling with snap-fit receptacles 192 and 194 of base 190 (further discussed below, see FIG. 11 and FIG. 12).

FIG. 7 and FIG. 8 further show two threading holes 158 of wheel bin 150, which are holes used for the passage of a shoelace into the apparatus 100. Threading holes 158 are also configured for alignment with threading holes 176 of winding wheel 170, as described above and further discussed below (see FIG. 9). Protrusions 160, best shown in FIG. 8, are narrow protrusions found on wheel bin 150, configured for snap-fit coupling with locking protrusions 112 (see FIG. 1) during assembly.

Figure 9:
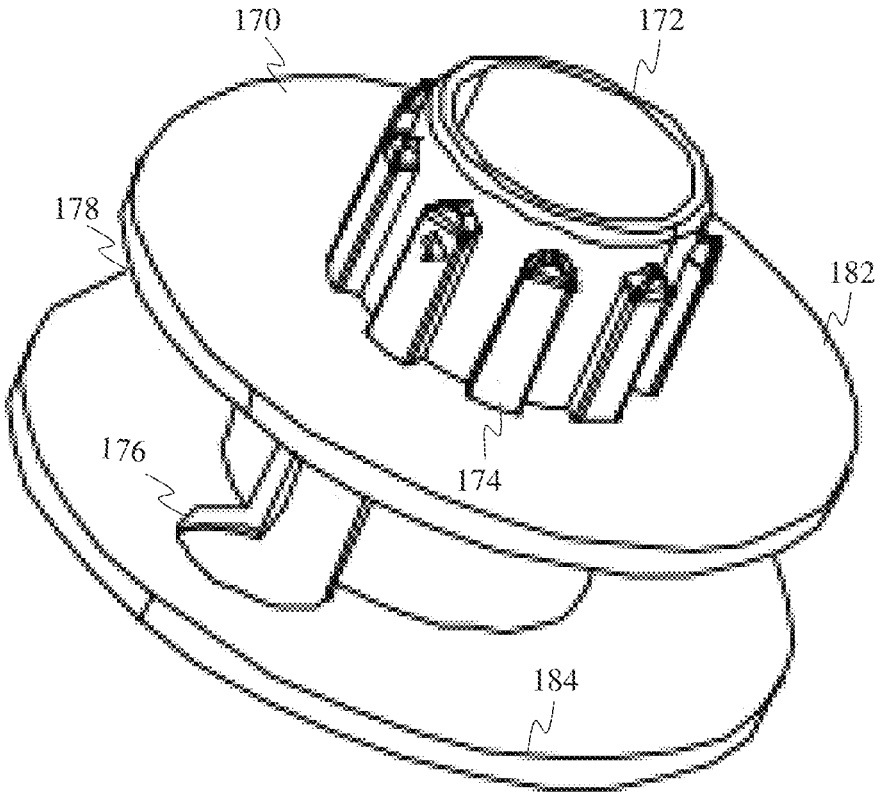
FIG. 9 is a drawing showing a top perspective view of the winding wheel of an apparatus for fastening shoelaces, according to one embodiment.

FIG. 9 is a drawing showing the winding wheel 170 of an apparatus for fastening shoelaces. The winding wheel comprises a central cylinder 172 with protruding load ribs 174. As discussed with reference to the ring structure 114 of the screw cap 110 shown in FIG. 1, loading ribs 174 couple securely to the loading ribs 116 of screw cap 110. FIG. 9 also shows threading holes 176 on either side of the cylinder 172, which are configured to permit the passage of shoelaces into the apparatus and allow the shoelaces to be wound into the threading channel 178 between disc elements 182 and 184. Threading channel 178 is merely a channel that acts as storage for shoelaces while the apparatus is in use and is created by disc elements 182 and 184, which surround central cylinder 170. Note that threading holes 176 extend through the disc 184 and the central cylinder 172.

Figure 10:
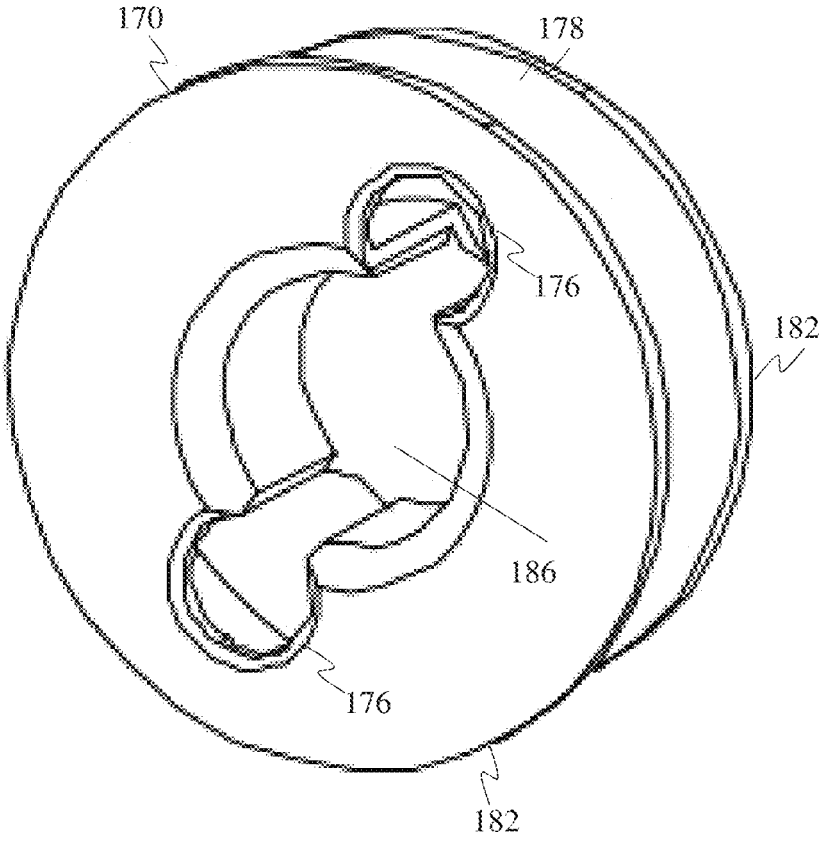
FIG. 10 is a drawing showing a bottom perspective view of the winding wheel of an apparatus for fastening shoelaces, according to one embodiment.

FIG. 10 is a drawing depicting the same winding wheel 170 as FIG. 9, in this instance showing a bottom view thereof. In FIG. 10, the threading holes 176 for aligning with threading holes 158 of wheel bin 150 are more apparent. FIG. 10 similarly shows threading channel 178 and additionally shows counterbore structure 186, which acts as a container for storing the knot of tied shoelaces. Counterbore structure 186 is a hollow channel that forms the inner portion of central cylinder 172 and acts as the central canal around which shoelaces are wound and stored inside of threading channel 178.

Figure 11:
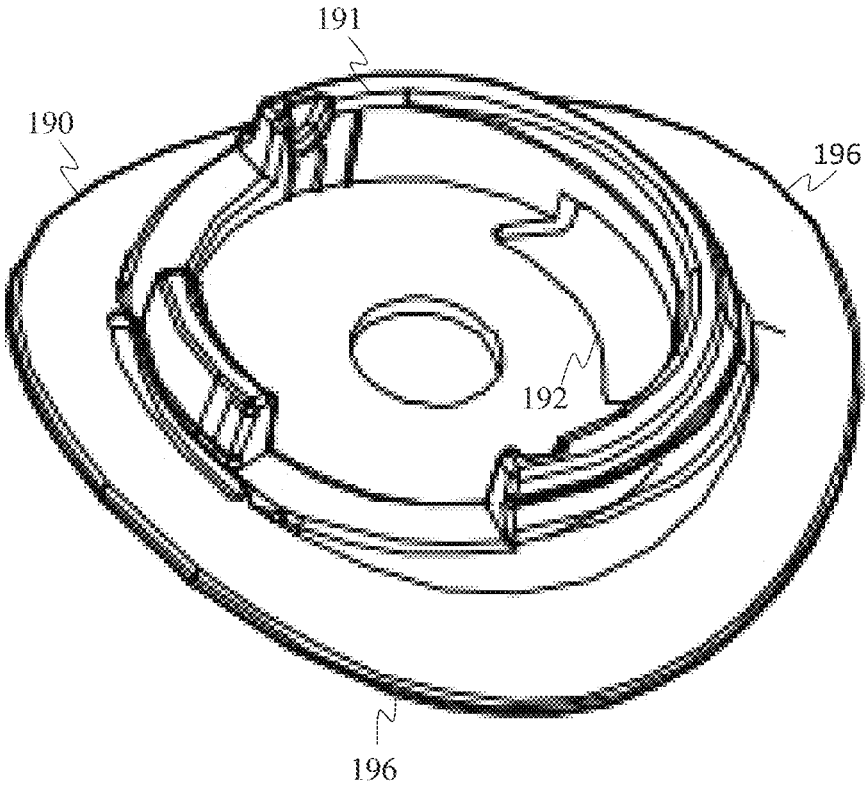
FIG. 11 is a drawing showing a top perspective view of the base of an apparatus for fastening shoelaces, according to one embodiment.
Figure 12:
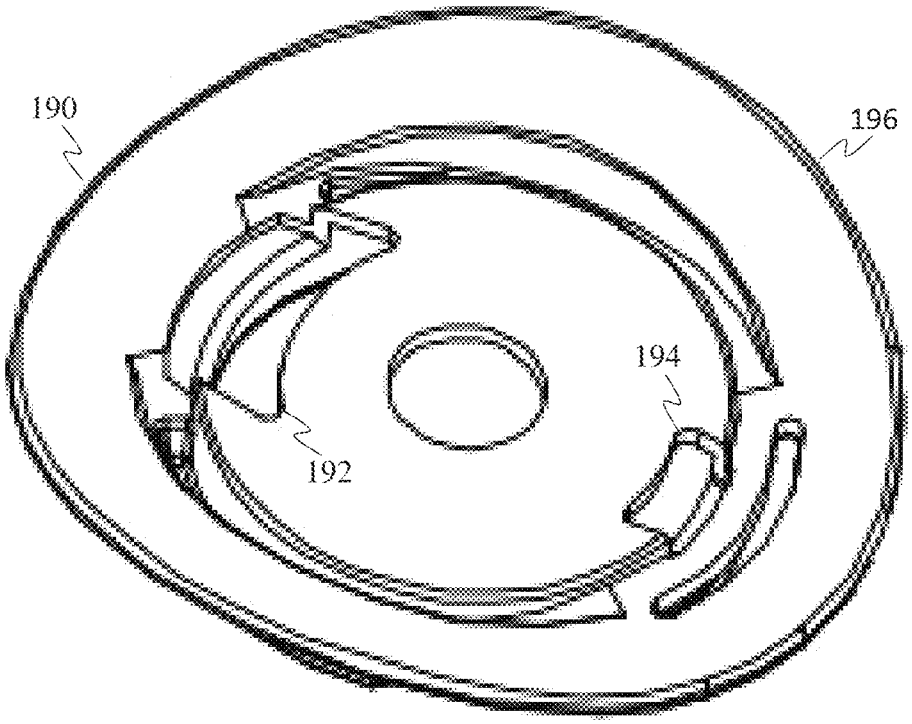
FIG. 12 is a drawing showing a bottom perspective view of the base of an apparatus for fastening shoelaces, according to one embodiment.

The base 190 of an apparatus for fastening shoelaces is disclosed in FIG. 11 and FIG. 12. The figures show a curved plastic surface element 196 with both large and small snap-fit receptacles 192 and 194, respectively. The curved plastic surface element is used in order to ensure the apparatus matches the natural contours of the human instep as well as the traditional shape used for the tongue of most styles of shoe. As mentioned with reference to FIG. 7, receptacles 192 and 194 are configured to allow a snap-fit with cantilever protrusions 154 and 156 (see FIG. 7). At the center, and on the top surface, of the base 190 there is a ring structure 191 which acts a receptacle for accepting the remaining parts of the device 100, as defined more fully below. The receptacles 192 and 194 of the base 190 defining mating orifices.

Figure 13:
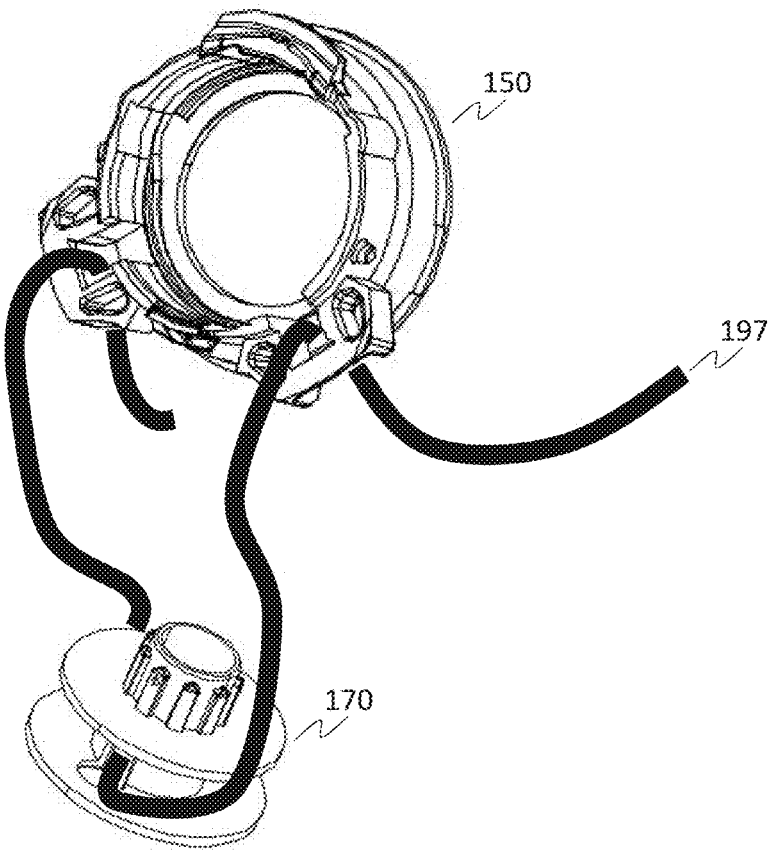
FIG. 13 is a drawing showing a perspective view of the wheel bin and winding wheel, including a shoelace threaded through both, according to one embodiment.

FIG. 13 is a drawing showing a perspective view of the wheel bin 150 and winding wheel 170, including a shoelace 197 threaded through both, according to one embodiment. FIG. 13 shows that the shoelace has been threaded through a first threading hole 158 of wheel bin 150, then through a first threading hole 176 of winding wheel 170, followed by being threaded through a second threading hole 176 of winding wheel 170, and finally through a second threading hole 158 of wheel bin 150.

Assembly of the device 100 occurs as follows. First, the shoelace 197 is threaded through the wheel bin 150 and winding wheel 170 as shown in FIG. 13. Next, the winding wheel 170 is inserted into the wheel bin 150 as show in FIG. 1. Then, the pawl ring 130 is inserted into the toothed ring 152 of wheel bin 150 such that the cylinder 172 of the winding wheel 170 extends through the central orifice or opening 139 of pawl ring 130, and such that the ratcheted ends 134 of the pawl ring engage with the toothed ring 152 of wheel bin 150. Then, the screw cap 110 is inserted on top of and over the wheel bin 140 such that the locking protrusions 112 fit over and around protrusions 160 of wheel bin 150 such that the protrusions 160 of wheel bin 150 prevent the screw cap 110 from being removed from the wheel bin. Also, when the screw cap 110 is inserted on top of and over the wheel bin 140, the ring structure 114 and peripheral ring structure 122 of screw cap 110 are inserted into and around pawl ring 130, such that the pawl ring 130 is held between the buckle structures 120 of ring structure 114 and the buckle structures 124 of peripheral ring structure 122. Finally, the wheel bin 150 is inserted into and on top of the base 190, such that the receptacles 192 and 194 snap-fit with cantilever protrusions 154 and 156 in base 190.

Operation of the device 100 occurs as follows. The user rotates the screw cap 110 in a first direction, which, in turn, rotates the winding wheel 170, which takes up length of shoelace into its channel 178, thereby tightening the shoelace. When the user rotates the screw cap 110, the pawl ring 130 is rotated inside the wheel bin in the direction allowed by the pawl ring, thereby making an audible clicking sound heard by the user as he turns the screw cap. Then the user rotates the screw cap 110 in a direction opposite to the first direction, which, in turn, rotates the winding wheel 170 in the opposite direction, which creates slack in the length of shoelace from its channel 178, thereby loosening the shoelace. When the user rotates the screw cap 110 in the opposite direction, the pawl ring 130 is not rotated inside the wheel bin, thereby no audible clicking sound is heard by the user.

The apparatus and each component discussed herein with reference thereto may be manufactured from a plastic compound using any variety of processes, such as injection molding, fusible core injection molding and thermoforming. Injection molding is a manufacturing technique for making parts from thermoplastic material in production. The most commonly used thermoplastic materials are polystyrene, ABS or acrylonitrile butadiene styrene, nylon, polypropylene, polyethylene, and polyvinyl chloride or PVC. Fusible core injection molding or lost core injection molding is a specialized plastic injection molding process. Thermoforming is a manufacturing process for thermoplastic sheet or film. The apparatus and each component discussed herein with reference thereto may be manufactured from a metal material.

In one embodiment, the apparatus may be manufactured from a material that is a solid color (or multiple solid colors), a transparent color (or multiple transparent colors) or may include a pattern or other series of multiple colors in a variety of selections. In another embodiment, there may be included graphics, designs, logos, pictures, or any images that can be applied to the planar sheets. The graphics may be embedded in the material comprising the apparatus or the graphics may be stamped, painted, stenciled, laser etched, printed, engraved or silk-screened onto the exterior or interior surfaces of the planar sheets.

Although specific embodiments have been disclosed, those having ordinary skill in the art will understand that changes can be made to the specific embodiments without departing from the spirit and scope of the claimed subject matter. The scope of the claimed subject matter is not to be restricted, therefore, to the specific embodiments. Furthermore, it is intended that the appended claims cover any and all such applications, modifications, and embodiments within the scope of the claimed subject matter

What is claimed is:

1. An apparatus for fastening a shoelace threaded in a shoe, the apparatus comprising:

(a) a wheel bin having a receptacle on its top surface, a toothed ring inside the receptacle, at least two orifices through which the shoelace is threaded, and at least two protrusions configured for coupling with mating orifices;

(b) a winding wheel that fits within the receptacle in the wheel bin, the winding wheel having a central cylinder with protruding load ribs, a channel for storing excess length of shoelace and at least two orifices through which the shoelace is threaded;

(c) a pawl ring that fits within the receptacle in the wheel bin, such that the central cylinder extends through a center of the pawl ring, the pawl ring having a plurality of ratcheted ends that engage the toothed ring;

(d) a base comprising a curved surface and a receptacle on the top side of the surface, the receptacle defining mating orifices configured for coupling with the at least two protrusions of the wheel bin, wherein said at least two protrusions extend through said mating orifices, so as to achieve a snap fit between the at least two protrusions and said mating orifices; and (e) a screw cap configured for placement on top of the wheel bin, the screw cap having a ring structure configured for coupling with the protruding load ribs of the winding wheel, (f) wherein when the screw cap is rotated, the winding wheel tightens the shoelace and stores excess length of shoelace in the channel.

2. The apparatus of claim 1, wherein the toothed ring comprises a ring having multiple gear teeth extending inward towards a center of the ring.

3. The apparatus of claim 1, wherein the at least two protrusions of the wheel bin are configured for a snap fit with the mating orifices.

4. The apparatus of claim 3, wherein the pawl ring includes three pawl arms, and wherein each pawl arm includes a ratcheted end that engages the toothed ring.

5. The apparatus of claim 4, wherein the mating orifices of the base are configured for a snap fit with the at least two protrusions of the wheel bin.

6. The apparatus of claim 5, wherein the pawl ring further comprises at least one groove configured for coupling with a mating protrusion.

7. The apparatus of claim 6, wherein the screw cap further comprises the mating protrusion configured for coupling with the at least one groove of the pawl ring.

8. The apparatus of claim 7, wherein the wheel bin, winding wheel, screw cap, pawl ring, base and screw cap are composed of plastic or metal.

9. An apparatus for fastening a shoelace threaded in a shoe, the apparatus comprising:

(a) a wheel bin having a receptacle on its top surface, a toothed ring inside the receptacle, at least two orifices through which the shoelace is threaded, and at least two protrusions configured for coupling with mating orifices;

(b) a winding wheel that fits within the receptacle in the wheel bin, the winding wheel having a central cylinder with protruding load ribs, a channel for storing excess length of shoelace and at least two orifices through which the shoelace is threaded;

(c) a pawl ring that fits within the receptacle in the wheel bin, such that the central cylinder extends through a center of the pawl ring, the pawl ring having a plurality of ratcheted ends that engage the toothed ring;

(d) a base comprising a curved surface and a receptacle on the top side of the surface, the receptacle defining mating orifices configured for coupling with the at least two protrusions of the wheel bin, wherein said at least two protrusions extend through said mating orifices, so as to achieve a snap fit between the at least two protrusions and said mating orifices; and (e) a screw cap configured for placement on top of the wheel bin, the screw cap comprising a circular disc, an outer wall and a central ring structure configured for coupling with the protruding load ribs of the winding wheel, (f) wherein when the screw cap is rotated, the winding wheel tightens the shoelace and stores excess length of shoelace in the channel.

10. The apparatus of claim 9, wherein the toothed ring comprises a ring having multiple gear teeth extending inward towards a center of the ring.

11. The apparatus of claim 10, wherein the at least two protrusions of the wheel bin are configured for a snap fit with the mating orifices.

12. The apparatus of claim 11, wherein the pawl ring includes three pawl arms, and wherein each pawl arm includes a ratcheted end that engages the toothed ring.

13. The apparatus of claim 12, wherein the mating orifices of the base are configured for a snap fit with the at least two protrusions of the wheel bin.

14. The apparatus of claim 13, wherein the pawl ring further comprises at least one groove configured for coupling with a mating protrusion.

15. The apparatus of claim 14, wherein the screw cap further comprises the mating protrusion configured for coupling with the at least one groove of the pawl ring.

16. The apparatus of claim 15, wherein the wheel bin, winding wheel, screw cap, pawl ring, base and screw cap are composed of plastic or metal.

* * * * *